US007438287B2

(12) United States Patent
Fournier

(10) Patent No.: US 7,438,287 B2
(45) Date of Patent: Oct. 21, 2008

(54) MECHANICAL DEVICE FOR RECEIVING DOCUMENTS

(75) Inventor: Patrick Fournier, Paris (FR)

(73) Assignee: SECAP Groupe Pitney Bowes S.A.S., Saint Denis LaPlaine (FR)

( * ) Notice: Subject to any disclaimer, the term of this patent is extended or adjusted under 35 U.S.C. 154(b) by 366 days.

(21) Appl. No.: 11/179,944

(22) Filed: Jul. 12, 2005

(65) Prior Publication Data

US 2006/0017222 A1 Jan. 26, 2006

(30) Foreign Application Priority Data

Jul. 13, 2004 (FR) ..... 04 07809

(51) Int. Cl.
*B65H 43/04* (2006.01)

(52) U.S. Cl. ..... 271/215; 271/213; 271/214

(58) Field of Classification Search ..... 271/181, 271/217, 214, 213, 215
See application file for complete search history.

(56) References Cited

U.S. PATENT DOCUMENTS 1,386,364 A * 8/1921 Pritchard ..... 271/215
4,012,036 A * 3/1977 Sokol ..... 271/215
5,288,066 A * 2/1994 Hain ..... 271/181
2004/0061282 A1 4/2004 Stemmle ..... 271/207

FOREIGN PATENT DOCUMENTS

DE 19507740 9/1996

* cited by examiner

*Primary Examiner*—Kaitlin S Joerger
(74) *Attorney, Agent, or Firm*—George M. Macdonald; Angelo N. Chaclas

(57) ABSTRACT

A device for receiving documents is described and in one example, a device for stacking media in a mail creation inserter system is described including at least one document support member (30), adapted to receive documents and to be moved along a longitudinal axis by its own weight, and an actuator member (32) for allowing said support to move, placed on the path of movement of the documents and adapted to move between a first or blocking position preventing longitudinal movement of said support and a second or released position allowing longitudinal displacement thereof, movement from the first position to the second position being triggered by the contact of at least one document (36) with said actuator member.

16 Claims, 10 Drawing Sheets

MECHANICAL DEVICE FOR RECEIVING DOCUMENTS

FIELD OF THE INVENTION

The present invention relates to a device for receiving documents and more particularly in certain embodiments to a system and method for stacking media in a mail creation inserter system.

BACKGROUND OF THE INVENTION

Document receiving devices known as "stackers" are used in the field of mail processing, for example, and in particular receive full envelopes from a machine for inserting documents into envelopes.

As is known in the art, envelopes coming from a machine for inserting documents into envelopes drop into a hopper in which, given the stream of envelopes leaving the machine, they are piled up higgledy-piggledy.

Accordingly, when the hopper is full and/or the machine for inserting documents into envelopes has ceased to function, human intervention is required to return the envelopes to the correct order and stack them to facilitate subsequent operations (routing, distribution, etc.).

It will be noted that the problems referred to above are not specific to envelopes and may relate to any type of document arriving in a common receiving device where they are liable to become mixed up.

It would therefore be useful to have a document receiving device preventing the mixing of documents.

SUMMARY OF THE INVENTION

The present application describes illustrative embodiments of a device for receiving documents and more particularly in certain embodiments to a system and method for stacking media in a mail creation inserter system. To this end, the present invention provides a mechanical device for receiving documents, comprising at least one document support member, called support, adapted to receive documents and to be moved along a longitudinal axis by its own weight, and an actuator member for allowing said support to move, placed on the path of movement of the documents and adapted to move between a first or blocking position preventing longitudinal movement of said support and a second or released position allowing longitudinal displacement thereof, movement from the first position to the second position being triggered as soon as a document applies a force to said actuator member.

BRIEF DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts. Other features and advantages of the invention will become apparent in the course of the following description, which is given by way of non-limiting example only and with reference to the following appended drawings.

DESCRIPTION OF THE PREFERRED EMBODIMENTS

Figure 1:
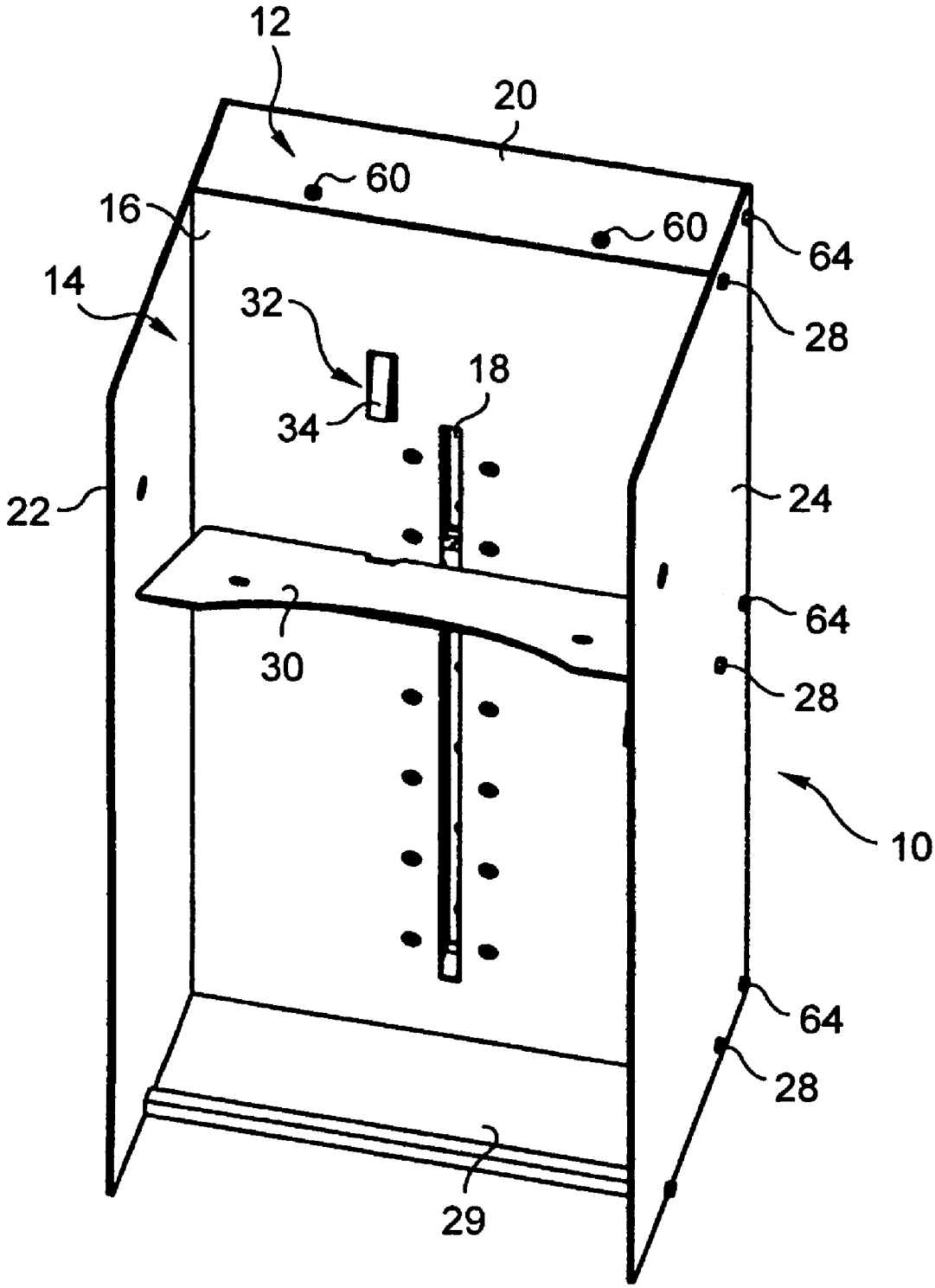
FIG. 1 is a perspective view of a device for receiving documents according to an illustrative embodiment of a postage evidencing system according to the present application.

The illustrative embodiments of the present application describe a device for receiving documents and more particularly in certain embodiments to a system and method for stacking media in a mail creation inserter system.

To this end, an illustrative embodiment of the present application describes a mechanical device for receiving documents, comprising at least one document support member, called support, adapted to receive documents and to be moved along a longitudinal axis by its own weight, and an actuator member for allowing said support to move, placed on the path of movement of the documents and adapted to move between a first or blocking position preventing longitudinal movement of said support and a second or released position allowing longitudinal displacement thereof, movement from the first position to the second position being triggered as soon as a document applies a force to said actuator member.

Thus the device of the invention operates in a simple manner since it is the contact of one or more documents with the actuator member that triggers the longitudinal movement of the support. Furthermore, the documents are stacked on the support in their order of arrival and without being mixed up.

Because the support moves as soon as a document applies a force to the actuator member, the device of the invention maintains a substantially constant distance between the area from which the documents come (inserter, franking machine, etc.) and either the support, if no document has yet arrived, or the last document that has arrived, which therefore ensures correct stacking of the document. Also, the support is adapted to receive documents of different sizes and weights. Furthermore, the device requires no electrical power supply, as it is purely mechanical and uses the weight of the support as the source of energy.

It may therefore readily constitute an independent module adding a new function to the units on its upstream side without calling into question their design. According to one feature, the actuator member is adapted to return to its first position after allowing the support to move, thereby preventing further movement until a new document arrives. The support therefore moves upon the arrival of each new document and for the time necessary for the actuator member to return to the blocking position. According to one feature, the actuator member is adapted to pivot about an axis perpendicular to the longitudinal axis.

According to one feature, the actuator member when in the blocking position is adapted to co-operate with an abutment member that is connected to the support in such a manner that, when the actuator member is in the released position, movement of the abutment member is driven by longitudinal movement of the support under its own weight. According to one feature, the abutment member is part of a cam that is adapted to rotate when the actuator member is in the released position. According to one feature, the device comprises means for reducing the mechanical torque needed to release the actuator member.

According to another feature, the means for reducing the mechanical torque needed to release the actuator member comprise a train of multiplier gears. According to one feature, the support is on one side of a separating wall and is connected to a connecting mechanism that is on the other side of the wall and is fastened to the abutment member via a longitudinal slot in the wall.

According to another feature, the actuator member comprises a first and a second portion and, when the actuator member is in the blocking position, the first portion projects from the support side of the wall and the second portion projects from the other side of the wall and co-operates with the abutment member. According to one feature, the support is mounted on a carriage fastened to the connecting mechanism. According to one feature, the carriage co-operates with a slideway. According to one feature, the carriage co-operates with a guide wall.

According to another feature, the carriage is fastened to a longitudinal movement transmission member that is part of the connecting mechanism and that runs around two transverse axes that are longitudinally spaced by a distance substantially equal to the travel of the support, and is adapted to rotate about these axes. According to one feature, the abutment member is adapted to rotate about an axis whose rotation is kinematically coupled to one of the transverse axes, referred to as the main axis. According to one feature, the means for reducing the mechanical torque needed to release the actuator member are, from the kinematic point of view, between the main axis and the abutment member.

According to one feature, the slideway is on the connecting mechanism side of the wall. According to one feature, the guide wall is the separating wall, the carriage co-operating with the edges of the slot to guide its longitudinal movement. According to one feature, the device comprises a support resetting mechanism for returning said support to an initial position when it reaches the end of its longitudinal movement. According to one feature, the device comprises a freewheel mounted on the main transverse axis.

According to one feature, the device comprises a brake that is adapted to slow the longitudinal movement of the support when the actuator member is in the released position. According to one feature, the brake is adapted to co-operate with one of the gears of the train of multiplier gears. According to one feature, the brake is between the main axis and the abutment member. According to one feature, the support is a plate. According to one feature, the support has a fixed orientation. According to one feature, the support is adapted to be oriented.

According to one feature, the support is adapted to be oriented manually. According to one feature, the support is adapted to be oriented automatically. According to one feature, the device comprises elastic members for holding the support which are adapted, if there are no documents on the support, to hold the latter in a raised position and, if there are documents on the support, to be elastically urged in such a manner as to orient the support in at least one lowered position. According to one feature, the longitudinal movement of the support is a vertical movement.

As shown in FIG. 1, a mechanical device 10 for receiving documents takes the form of a box divided into two compartments 12 and 14 by a separating wall 16 in which there is a longitudinal slot 18. The compartment 12 is enclosed within a protective casing 20 that has been removed in FIG. 2.

Figure 2:
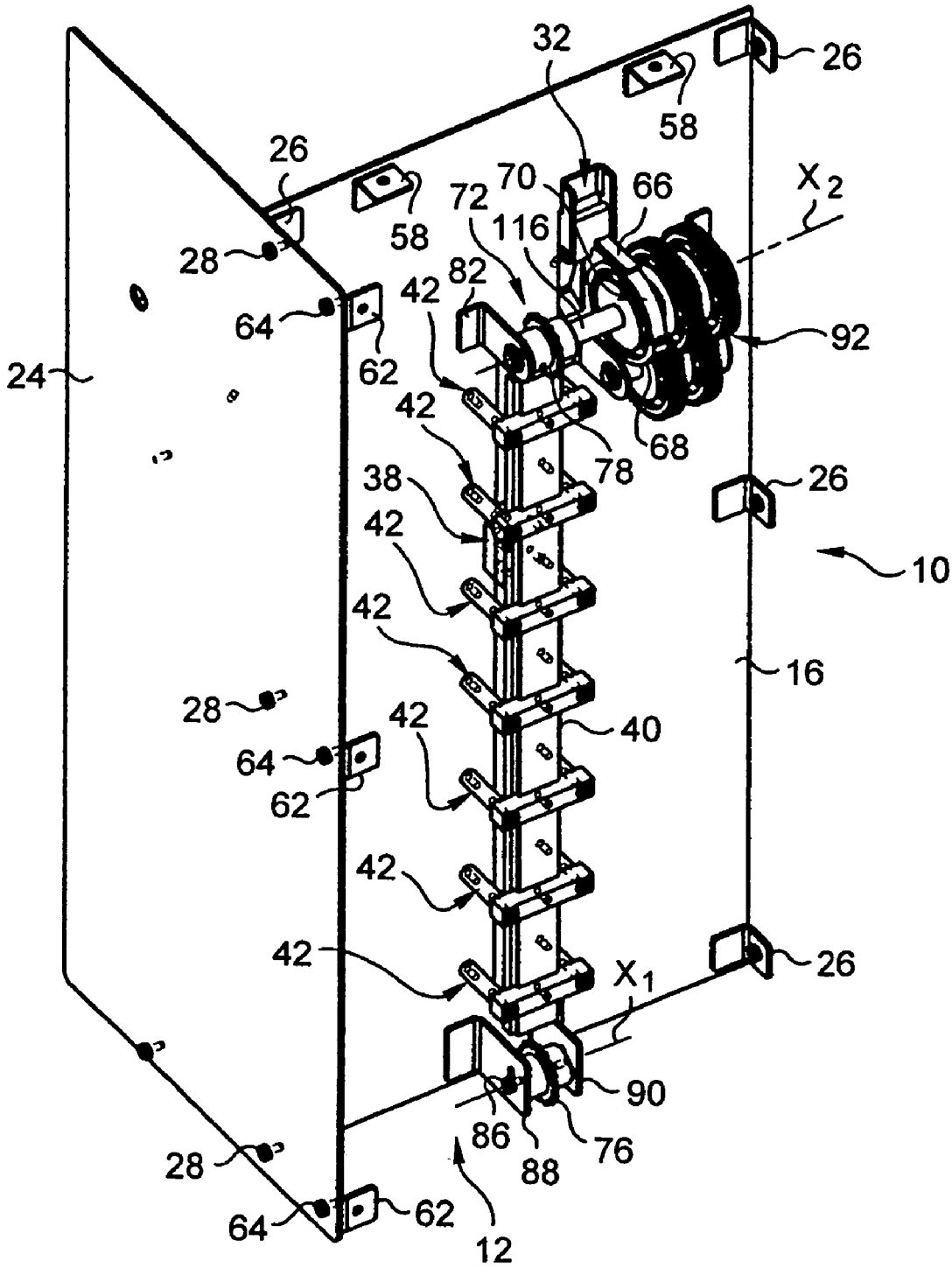
FIG. 2 is a rear perspective view of the FIG. 1 device with a protective casing 20 removed.

The box comprises two walls 22 and 24 perpendicular to the separating wall 16 and fixed to the latter by angle brackets and fixing screws 26 and 28 that may be seen in FIG. 2. A portion of the walls 22 and 24 partly defines the open compartment 14 (FIG. 1) while the other portion partly defines the closed compartment 12 (FIG. 2). A crossmember 29 in the lower portion of the box stiffens the two walls 22 and 24. A document support member taking the form of a plate 30 is arranged in the open compartment 14 between the two walls 22, 24 and against the separating wall 16. This support is adapted to receive documents such as envelopes coming from an inserter or some other machine that is on its upstream side in the document processing direction.

This support is adapted to move along a longitudinal axis parallel to that of the longitudinal slot 18 under its own weight and that of the documents that it supports. It will be noted that, in the embodiment shown in the figures, the box is vertical and the longitudinal movement of the support is therefore a vertical movement. However, in different embodiments, the support could move along an incline. In this embodiment, the support has a fixed orientation to the horizontal.

Figure 3:
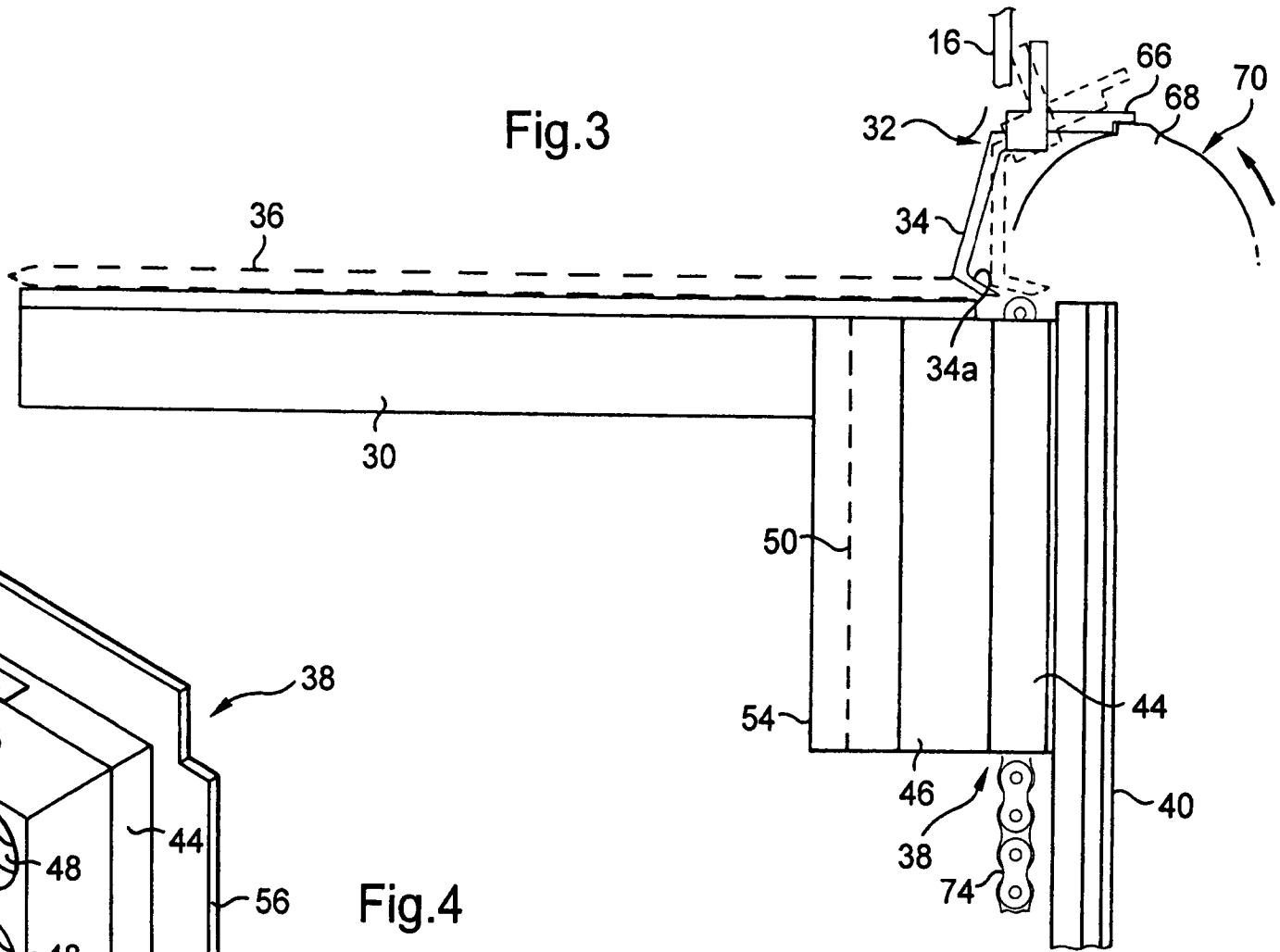
FIG. 3 is a view in partial longitudinal section of a first embodiment of a support 30 in section in the median plane of a longitudinal slot 18 shown in FIG. 1.

As shown in FIG. 3, the support 30 is disposed horizontally, for example. It may alternatively be disposed at a given inclination to the horizontal. It should be noted that the embodiment shown in the figures has only one document support member, taking the form of a plate, whereas a plurality of document support members could instead be envisaged. Thus, to indicate one nonlimiting example of this alternative, plate portions, tabs or portions of rigid metal wire disposed substantially parallel to each other and aligned with the slot 18 could be used. Also, a differently oriented reinforcing member may be added to the support members.

There being only one support which has a rigid metal wire structure similar to that of some facsimile machine reception trays may equally be envisaged. There is an actuator member 32 for allowing movement of the support 30 on the path of the documents when they drop along the wall 16 after they exit the inserter. The actuator member is mobile between two end positions of which a first, called blocking position, is represented in FIGS. 1 to 3 in continuous outline; in this position longitudinal movement of the support 30 is prevented by a mechanism to be explained hereinafter. In this position, a first portion 34 of the actuator member projects from the separating wall 16 on the same side of the latter as the support 30.

Upon the arrival of a document 36 (see FIG. 3), said document comes into contact with the portion 34 of the actuator member before dropping onto the support 30, which causes the member to retract to a second end position (represented in dashed outline in FIG. 3) in which longitudinal movement of the support under its own weight is allowed, as explained later.

It will be noted that, for a first use (reception of the first document(s)), the support is preferably located in the vicinity of the actuator member 32, as shown in FIG. 3, rather than far away from it, as shown in FIG. 1. In this case, the first document(s) come into contact with the support at the same time as they co-operate with the member 32. The FIG. 1 position is nevertheless equally possible for receiving the first document(s), and in this case the first document(s) come(s) into contact with the member 32 before being received on the support 30. Furthermore, after longitudinal movement of the support has been enabled, once the actuator member is no longer in contact with the document(s), it returns to its first blocking position, thereby preventing movement of the support until the next document arrives.

In FIG. 2, removing the protective casing has exposed brackets 58 for fixing the cover shown in FIG. 1 by means of fixing screws 60 (FIG. 1). Fixing brackets 62 are also provided for fixing the rear wall, not shown, by means of fixing screws 64.

Figure 4:
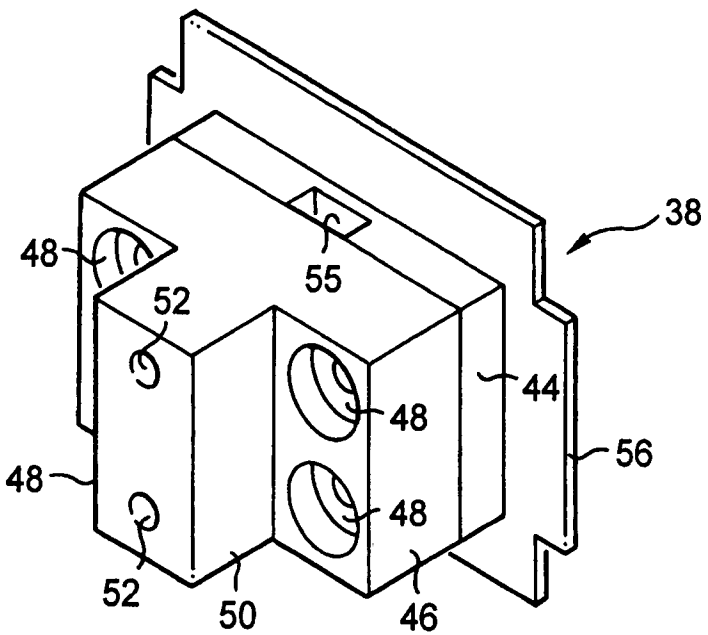
FIG. 4 is a perspective view of a carriage 38 shown in FIG. 3.

As shown in FIG. 3, the support 30 is mounted on a carriage 38 which is in turn mounted in a slideway 40 parallel to the separating wall 16 and arranged facing the slot 18, on the opposite side of the wall to the support. The slideway 40, also shown in FIG. 2, is disposed against the wall 16 and retained by fixing U clips 42 disposed along the whole of its length. For simplicity, these clips are not shown in FIG. 3. Co-operation of the carriage 38 with the slideway 40 guides longitudinal movement of the support 30. The carriage 38 is in two parts, comprising a slider 44 and a counter-slider 46 fixed together by means of fixing screws that are not shown in FIG. 4 but are engaged in housings 48 provided for this purpose that pass through the counter-slider 46 and penetrate the slider 44.

The counter-slider 46 has a projection 50 in which there are two orifices 52. The support 30 has a vertical extension 54 provided with orifices, not shown, and facing the projection 50 of the carriage, to which it is fixed by means of fixing screws, not shown, that are inserted into the orifices in the extension 54 and into the corresponding housings 52 in the projection 50. The carriage 38 has at its base a shoe 56 adapted to slide inside the slideway 40 whose opening is oriented toward the wall 16. The support 30 is connected by means of the carriage 38 to a connecting mechanism that is in turn connected to an abutment member with which the actuator member 32 co-operates when in its blocking position.

As shown in FIGS. 2 and 3, the actuator member 32 has a second portion 66 which, in the blocking position, co-operates with one of abutment members 68 of a cam 70. When, following contact of a document with the first portion 34 of the actuator member 32, the second portion 66 of the member is no longer in contact with the abutment member 68 of the cam 70, the weight of the support 30, that moves the latter longitudinally (for example downward), drives rotation of the cam 70 about its central axis via the connecting mechanism 72, which is described next. It should be noted that the weight of the documents supported by the support is added to the weight of the latter to drive the cam.

The carriage 38 is fastened to an articulated chain 74 shown in FIG. 3 which, firstly, is engaged in a groove 55 of the slider 44 parallel to the projection 50 (FIG. 4) and held in position inside the groove by teeth disposed transversely along the groove (these teeth are represented in an embodiment shown in FIG. 10 and described subsequently) and, secondly, runs around two transverse axes X1, X2 (FIG. 2) that are longitudinally spaced by a distance substantially equal to the longitudinal travel of the support 30. The movement transmission member formed by the chain 74 turns about these axes on two sprocket wheels 76, 78 freely rotatable on two shafts coaxial with the axes X1 and X2, respectively. The chain 74 may be replaced by any other movement transmission member, such as a belt, or any other member with the same function.

Figure 5B:
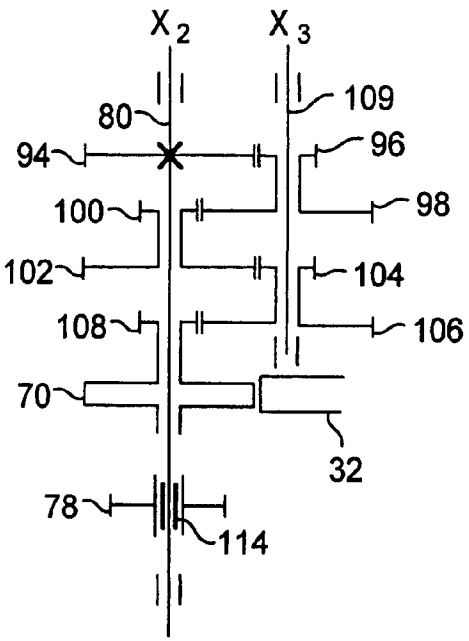
FIG. 5*b* is a diagrammatic view of the mechanism shown in FIG. 5*a*.
Figure 5A:
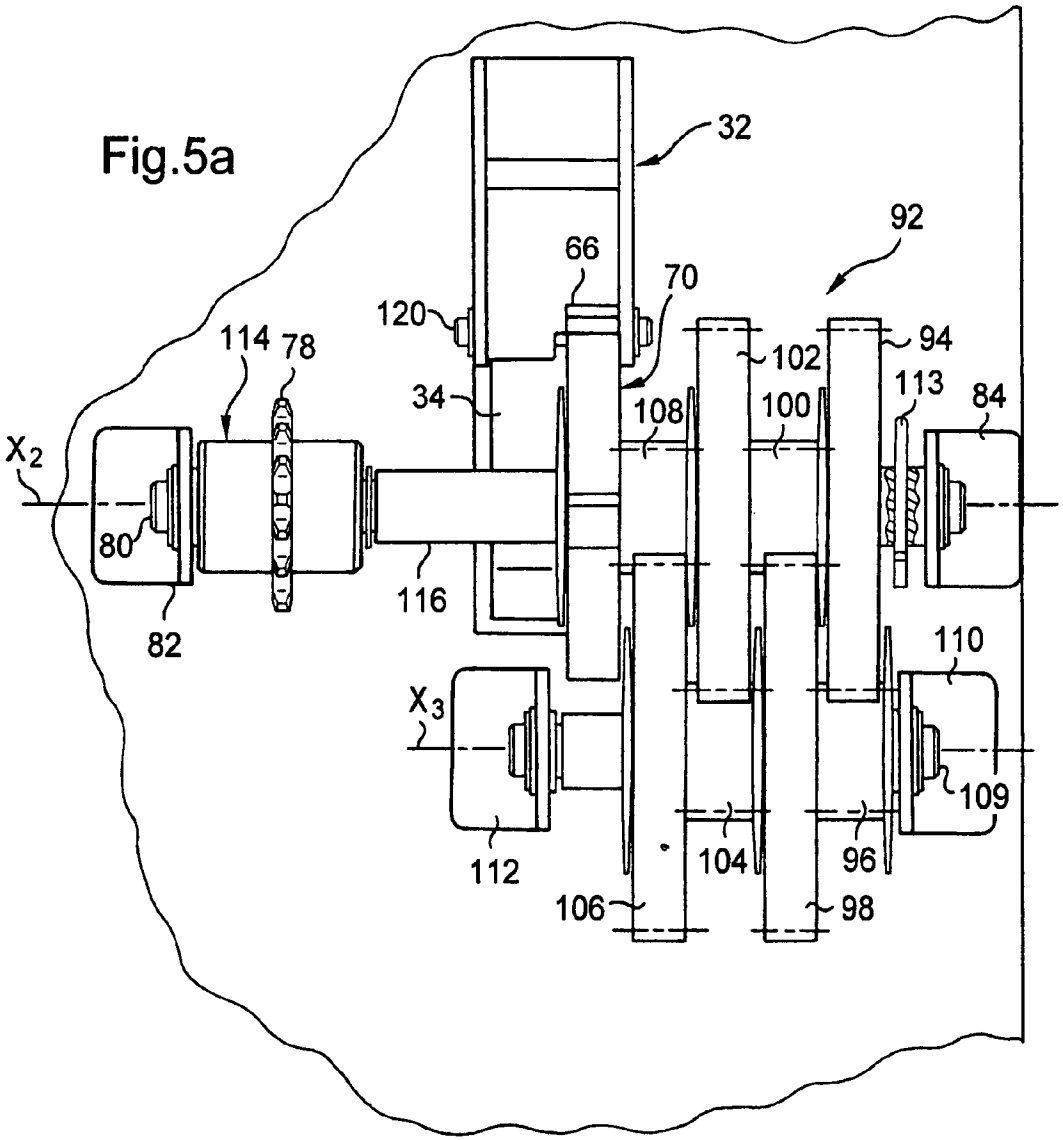
FIG. 5*a* is a view to a larger scale of the mechanism 92 shown in FIG. 2.

As shown in FIGS. 2 and 5*a*, the shaft 80 coaxial with the main transverse axis X2 on which the sprocket wheel 78 is mounted is supported by two brackets 82 and 84 that are fastened to the separating wall 16. The shaft 86 on which the sprocket wheel 76 is mounted is supported by two brackets 88 and 90 that are fastened to the separating wall 16 (see FIG. 2).

As shown in FIGS. 2 and 5*a*, the abutment member 68 rotates about the main transverse axis X2. The device 10 also comprises means 92 for reducing the mechanical torque necessary for releasing the actuator member. These means reduce the force that has to be applied to move the actuator member 32 from the position shown in full line in FIG. 3 to that shown in dashed line relative to the force that would have to be applied by a direct drive arrangement. Thanks to means 92 described hereinafter, a weight of no more than 20 g, for example, which corresponds to the average weight of a filled envelope, is sufficient to pivot the actuator member about its axis 120. The means 92 are kinematically arranged between the abutment member and the main axis X2, and comprise a train of multiplier gears connected at the input end to the sprocket wheel 78 and at the output end to the stop cam 70 (see the developed view of the mechanism in FIG. 5*c*).

The train of multiplier gears, whose overall multiplication ratio is 81, comprises four sets of gears or sprockets each with a ratio of 3:1, namely a first set consisting of the gears 94 and 96, a second set consisting of the gears 98 and 100, a third set consisting of the gears 102 and 104, and a fourth set consisting of the gears 106 and 108.

Figure 5C:
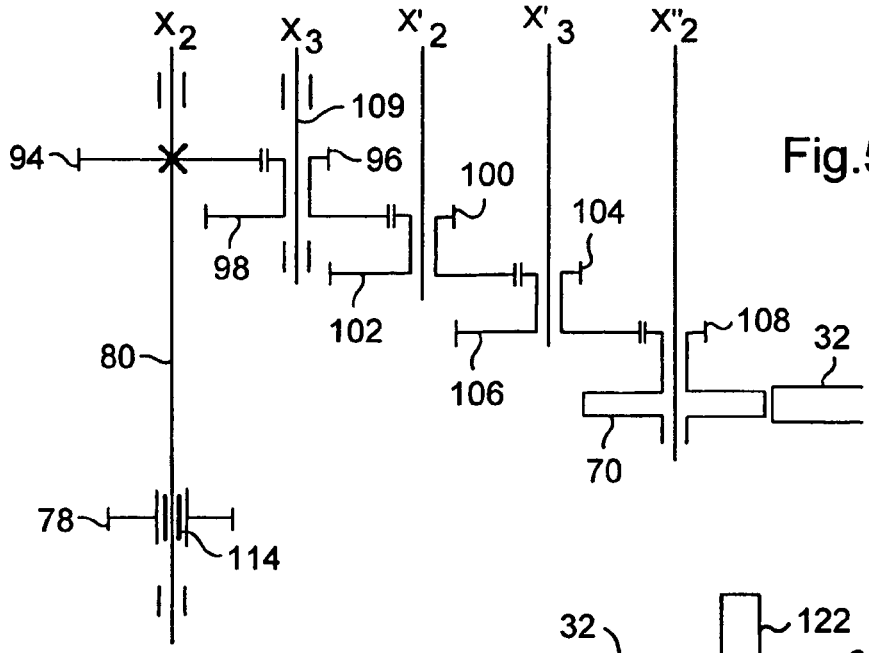
FIG. 5*c* is a developed view of the mechanism shown in FIGS. 5*a* and 5*b*.

As shown diagrammatically in FIGS. 5*b* and 5*c*, the stop cam 70 and the gear 108 are fastened together. This assembly is free to rotate about the axis X2 when it is not immobilized by the portion 66 of the actuator member 32. The gears 96 and 98 are fastened together and this assembly is free to rotate on a shaft 109 with an axis X3 parallel to the axis X2 and supported by two brackets 110 and 112 fastened to the wall 16. The gears 100 and 102 are fastened together and this assembly is free to rotate about the axis X2. The gears 104 and 106 are fastened together and this assembly is free to rotate about the axis X3. The gear assemblies 96/98, 100/102, 104/106 are identical, for example. The gear 94 is fastened by means of a pin 113 to the shaft 80 on which the gear 78 is mounted. Other means of reducing the mechanical torque necessary for releasing the actuator member may be envisaged in place of that described hereinabove.

It will be noted that the device 10 comprises a mechanism 114 for resetting the support 30 which, when the support is at the end of its travel (in its lowermost position in the slot 18 shown in FIG. 1), it returns the support to an uppermost position, called the initial position, after the documents that have accumulated on the support have been removed. The mechanism 114 takes the particular form of a freewheel known in the art mounted on the shaft 80. A spacer 116 is provided between the freewheel 114 and the stop cam 70. When the cam 70 is not immobilized by the actuator member 32, the mechanism moves in the manner indicated hereinafter (see FIGS. 5*b* and 5*c*).

The weight of the plate transmitted to the chain 74 causes the gear 78 to turn, driving rotation of the shaft 80, to which the gear 94 is fastened via the free wheel. The gear 94 then drives rotation about the axis X3 of the gear 96 fastened to the gear 98, which in turn drives rotation about an imaginary axis X'2 of the gear 100 fastened to the gear 102. The gear 102 drives rotation about an imaginary axis X'3 of the gear 104 fastened to the gear 106, which drives rotation about an imaginary axis X"2 of the gear 108 fastened to the cam 70.

Figure 6:
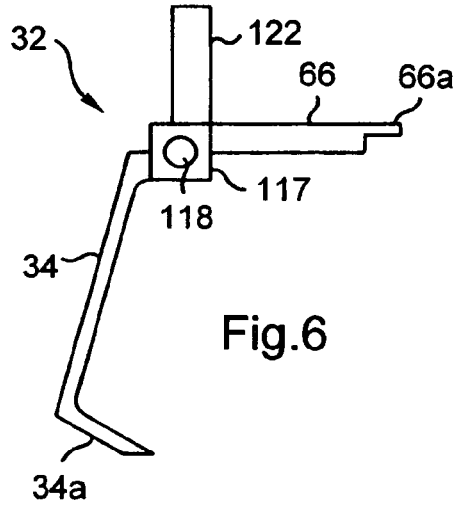
FIGS. 6 and 7 are respectively a side view and a perspective view of an actuator member 32.

When the member 32 immobilizes the cam 70, the whole of the gear train 108-106-104-102-100-98-96-94-80-78 is immobilized, and this prevents downward movement of the support. The actuator member 32 and the stop cam 70 are described in more detail next with reference to FIGS. 6 to 8. The actuator member 32 comprises an elongate body 117 through which passes a housing 118.

Figure 7:
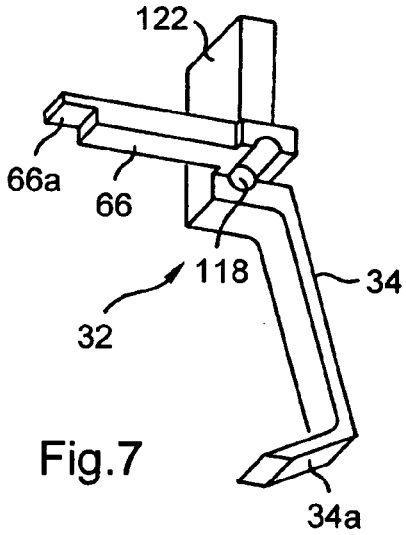

As shown in FIG. 7, this housing is only partly cylindrical, a portion of the body 117 having been eliminated to facilitate fitting the member around the pivot 120 (FIG. 5*a*) that is perpendicular to the longitudinal axis of movement of the support and parallel to the axes X1, X2 and X3. The member 32 comprises a leg 34 inclined to the vertical which constitutes the first portion referred to above and has an end 34*a* curved toward the wall 16. The curvature of the leg 34 is particularly beneficial when manually offloading stacked envelopes from above, as it prevents snagging of the envelopes and damage to the member 32. The member 32 comprises an arm 66 which constitutes the second portion referred to above and is provided with a finger at its end 66*a*. The arm 66 and the leg 34 are attached to the body 117, as is a vertical extension 122 whose function is to adjust the weight and the center of mass of the member so that it naturally assumes the position shown in FIGS. 3 and 6.

Figure 8:
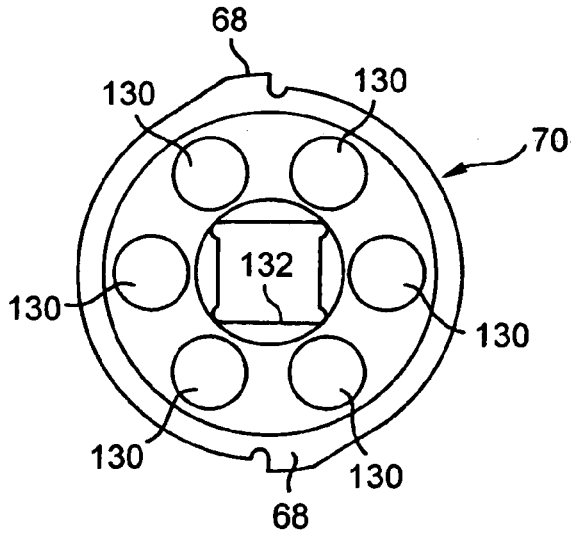
FIG. 8 is a side view of a stop cam 70 shown in FIGS. 3 and 5*a*.

It will be noted that the weight and the center of mass of the member 32 may be adjusted without this vertical extension being present. In that case, it is sufficient to lengthen to a greater or lesser degree one of the first or second portions 34 and 66 and/or to increase to a greater or lesser degree their weight. As indicated above, the stop cam 70 carries two abutment members 68 and is shown in FIG. 8 in a position that is the opposite of that shown in FIG. 3. The number of abutment members 68 determines how far the support 30 moves on receiving one or more documents triggering retraction of the actuator member 32. It should be noted that the amplitude of the movement may be increased by reducing the number of stop members or reduced by increasing that number.

It will be noted that the stop cam 70 takes the form of a wheel (FIG. 8) comprising a plurality of orifices to reduce the weight of the wheel, for example six orifices 130. A substantially square central passage 132 allows the wheel to be mounted on a part which is fastened to the gear 108 (FIG. 5*b*) and has a square external shape complementary to that of the passage 132. The part fastened to the gear 108 has a cylindrical internal shape enabling it to be mounted on the shaft 80.

Similarly, the pairs of members 96/98, 100/102 and 104/106 are made in two separate parts that are easy to manufacture and allow rotational coupling of the two assembled parts; one of the two parts has a square male portion and the other part has a square broached female portion with the same dimensions. The supporting part of the square male portion has a cylindrical hole through it and is free to rotate about the shaft 80 or the shaft 109. Nevertheless, it will be noted that the pairs of members 70/108, 96/98, 100/102 and 104/106 may each be in one piece.

Thus thanks to its weight, the support 30 constitutes the "motor" of the mechanical device 10 for receiving documents, and drives movement of an abutment member via the transmission member 74 and the remainder of the connecting mechanism 72. In its natural position, the second portion 66 of the actuator member 32 co-operates with the abutment member 68, thereby preventing rotation of the stop cam 70 and blocking longitudinal movement of the support 30.

When the first portion 34 of the actuator member 32 is activated by the arrival of one or more documents, the member assumes the retracted (released) position indicated in dashed outline in FIG. 3 and releases the stop cam 70, which is then able to turn about the axis X2. Releasing the cam then allows movement of the support under its own weight, and the weight of the documents that it is supporting if there are already documents on the support.

Figure 9B:
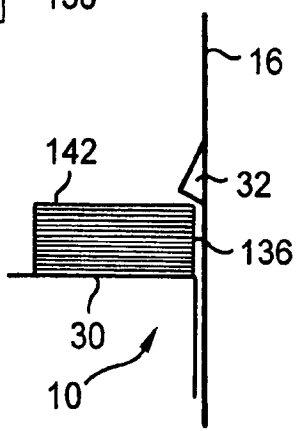
FIGS. 9*a* and 9*b* are two different views showing the use of the device of FIG. 1 for receiving documents.
Figure 9A:
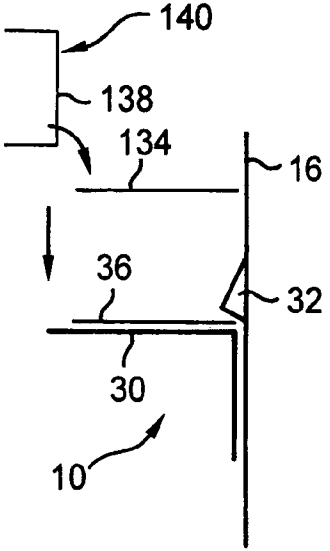

FIGS. 9*a* and 9*b* respectively show the arrival of a new document 134 on the support 30, which has previously received the document 36, and a stack of documents 136 already received by the support 30. The weight of the documents 136 may be several kilograms, for example 5 to 8 kg of envelopes.

It will be noted that the device of the invention maintains a substantially constant distance between the document exit region 138 of the inserter or the machine 140 for placing documents in envelopes and the last envelope received by the support, namely the envelope 36 in FIG. 9*a* or the envelope 142 in FIG. 9*b*. This ensures correct stacking of documents. The device accepts documents of varying dimensions and, in the case of envelopes, with varying contents. It will further be noted that the documents are not mixed up as in the prior art and adopt a predetermined order.

Here the order is the reverse of that in which the documents arrive: the last document received is the first document on the top of the stack. Furthermore, the device 10 may be used with a machine 140 such as an inserter or a machine for placing documents in envelopes, or even some other machine, without it being necessary to provide a communication interface therewith. The device 10 of the invention therefore constitutes a module that is independent of the machine supplying the documents, of particularly simple design and very reliable.

Another embodiment is described next with reference to FIGS. 10 to 13. In these figures, only components modified relative to those shown in the previous figures carry new reference numbers. In this embodiment, the document support 150 is again a horizontal plate, but it could have a different angular orientation to the horizontal, as explained with reference to the support 30 shown in the previous figures. The support 150 is mounted on a carriage 152 (see FIGS. 10 and 11) by means of two fixing screws 154, 156. The carriage 152 is in two parts, comprising a slider 158 and a counter-slider 160 fixed together by three fixing screws 162, 164, 166 in respective housings 168, 170 and 172 passing completely through the thickness of the component 160 and a portion of the component 158.

Four holes 174, 176, 178 and 180 through the counter-slider 160 (see FIG. 11) may be used to fix it to a different type of support that is adapted to be oriented, for example that to be described hereinafter with reference to FIGS. 14 to 16. The aforementioned holes are therefore not used for the support 150. An upper bearing 163 and a lower bearing 165 (see FIGS. 10 and 11) disposed between the slider 158 and the counter-slider 160 keep the support 150 and the carriage 152 vertical, in order to prevent lateral tilting of the assembly. The slider 158 has on the side opposite that fixed to the counter-slider 160 a member 182 that is used to fix the transmission member 74 shown in FIG. 3, which takes the form of a chain, for example.

Just as in FIG. 3, the U-shaped member 182 has a longitudinal recess or groove 184 adapted to receive the chain 74. A plurality of teeth 186 fastened to the slider 158 are intended to retain the chain 74, which still runs around the gears 76 and 78 shown in FIG. 2. The member 182 forms a cover and is positioned against the slider 158 so that the chain 74 may not escape from the teeth 186. In this embodiment, the support 150 is no longer guided in translation by the carriage that slides in the slideway 40 shown in FIG. 3, but instead by means of rollers 188, 190, 192 and 194 on the counter-slider 160 (see FIG. 11) and rollers 196, 198, 200 and 202 on the slider 158 (see FIG. 12). The rollers mounted on respective opposite edges of the counter-slider 160 and the slider 158 co-operate with respective opposite faces of the separating wall 16 to guide movement in translation of the carriage.

Figure 10:
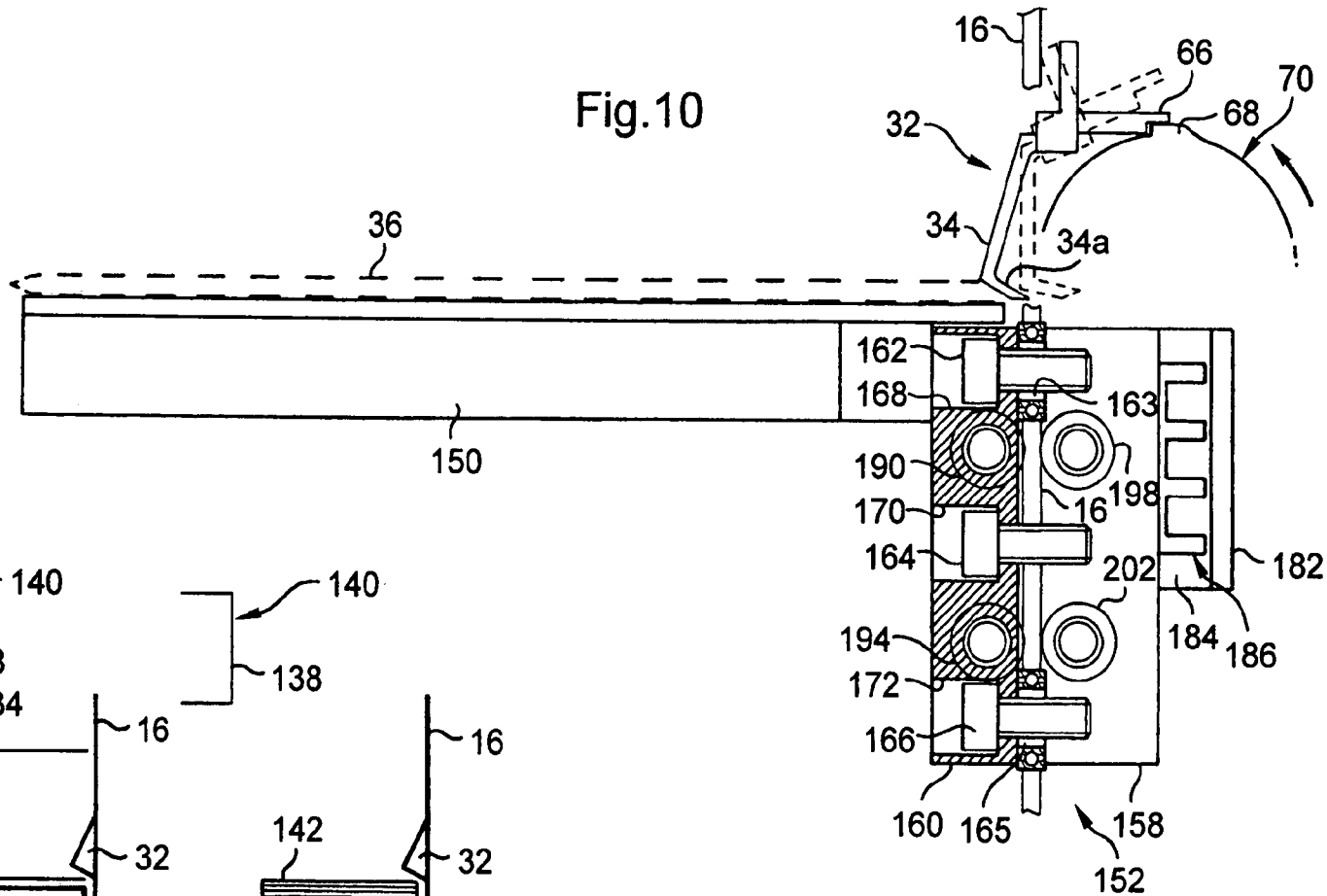
FIG. 10 is a diagrammatic view of a second embodiment of the document support.

FIG. 10 shows the rollers 190 and 194 of the counter-slider 160 and the rollers 198 and 202 of the slider 158 in contact with respective opposite faces of the separating wall 16. The rollers of the slider and the counter-slider may be at a greater or lesser distance from the longitudinal slot 18 and may therefore co-operate more particularly either with its edges or with a region of the wall away from its edges. It should be noted that the rollers of the slider and the counter-slider absorb forces exerted on the support, in particular by the weight of the support and the documents, and especially on sudden starting and stopping of movement of the support.

Figure 12:
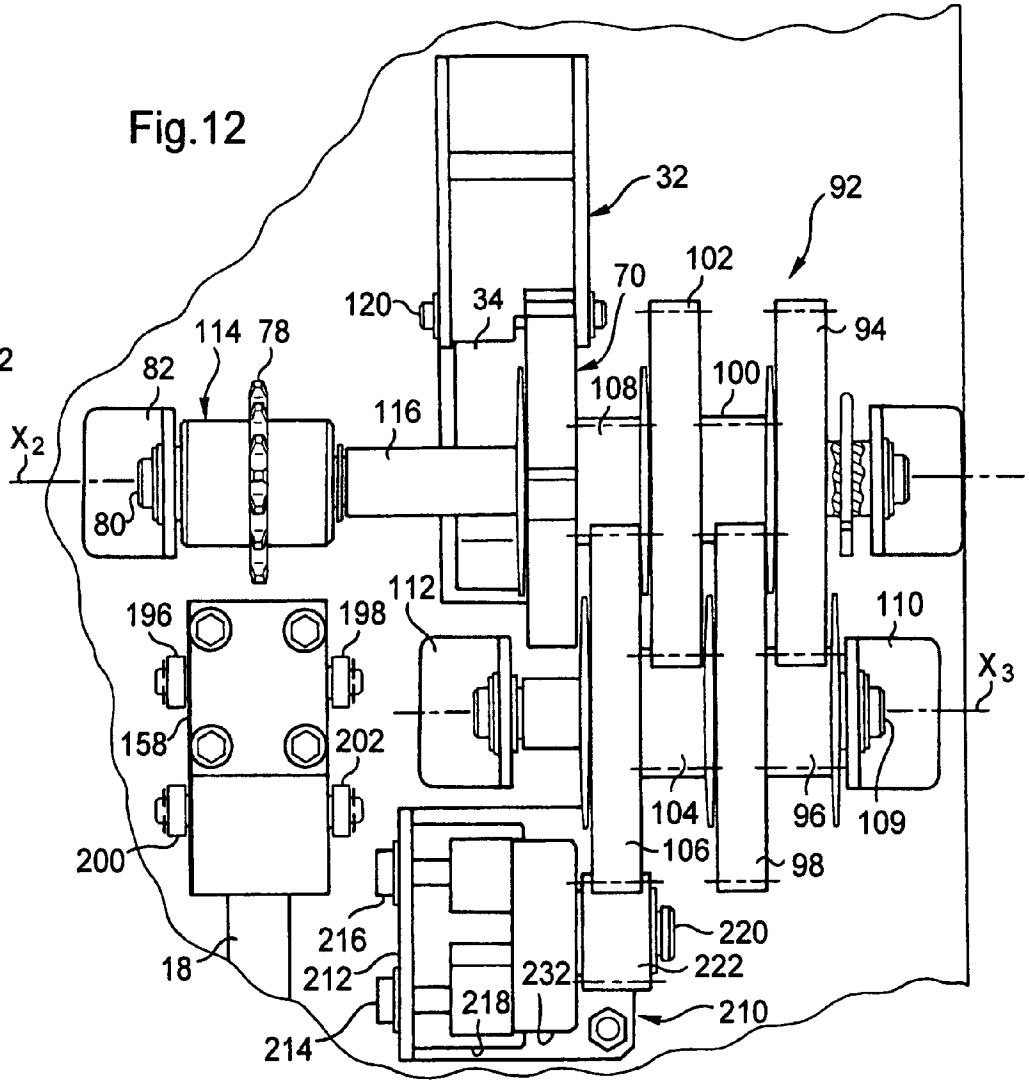
FIG. 12 is another embodiment showing a front view of the mechanism shown in FIG. 5*a* incorporating the second embodiment of the document support shown in FIGS. 10 and 11.
Figure 11:
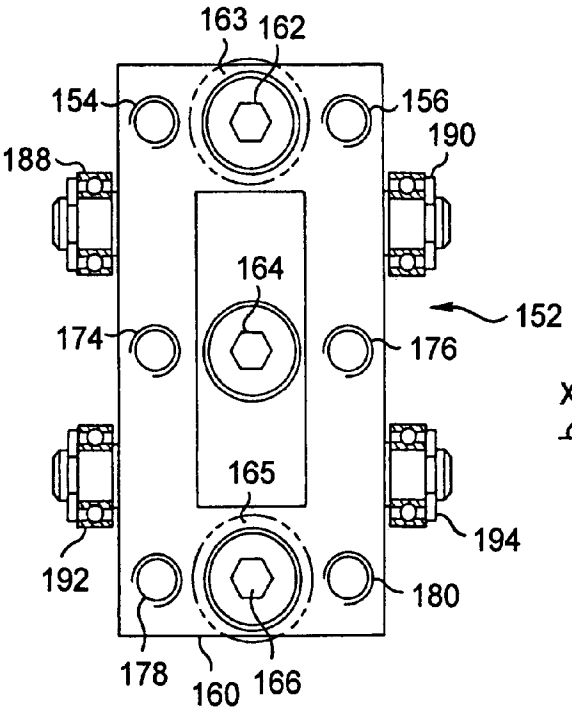
FIG. 11 is a front view of a part 160 shown in FIG. 10 in a plane parallel to the separating wall 16.

The embodiment of the device shown in FIGS. 11 and 12 further comprises a braking mechanism 210 that is adapted to slow down the longitudinal movement of the support 150 when the actuator member 32 is in the released position. The mechanism 210 is fixed to a bracket 212 by fixing screws 214, 216 and this bracket is in turn fixed to the vertical wall 16 by a curved portion 212*a* of a part 212 (see FIG. 13). In terms of the kinematics of the movement, the braking mechanism is between the main axis X2 and the abutment member.

The braking mechanism 210 comprises a bell 218 fixed to the part 212 by the screws 214, 216 and having a central hub 220 around which a gear 222 force-fitted into a plate 232 meshes with the gear 106 of the gear train 92 (see FIG. 12). An annular recess 221 in the bell 218 around the hub 220 receives two weights 224 and 226, which are of semicircular shape, for example, and fit over fingers 228, 230 carried by the plate 232, facing the annular recess 221 and surrounding the base 222*a* of the gear 222.

Bearings 234 and 236 are provided between the gear 222 and the central hub 220. This centrifugal braking mechanism is particularly efficient in the case of high rotation speeds of the gears, and of the gear 106 in particular. This is because, at high rotation speeds, the weights 224 and 226 tend to move apart, because of the effect of centrifugal force, and rub against the larger diameter inside wall of the annular recess 221, thereby slowing down the gear 222 and the gear 106.

It will be noted that the braking mechanism 210 may be installed on gears other than the gear 106 of the gear train 92, but it would then be less efficient than in the position shown in FIG. 12, as the other gears turn more slowly than the gear 106. However, other braking mechanisms may be used in the device of the invention and may then be disposed elsewhere. Alternatively, the device of the invention may comprise other connecting mechanisms between the document support and the abutment member.

A braking mechanism could also be used in relation to the device shown in FIGS. 1 to 9. However, it proves of more benefit in the second embodiment shown in FIGS. 10 to 13, in which the support is liable to move faster. An appropriate braking mechanism could be installed on at least some of the rollers of the slider and/or the counter-slider of the carriage 152, for example.

Figure 14:
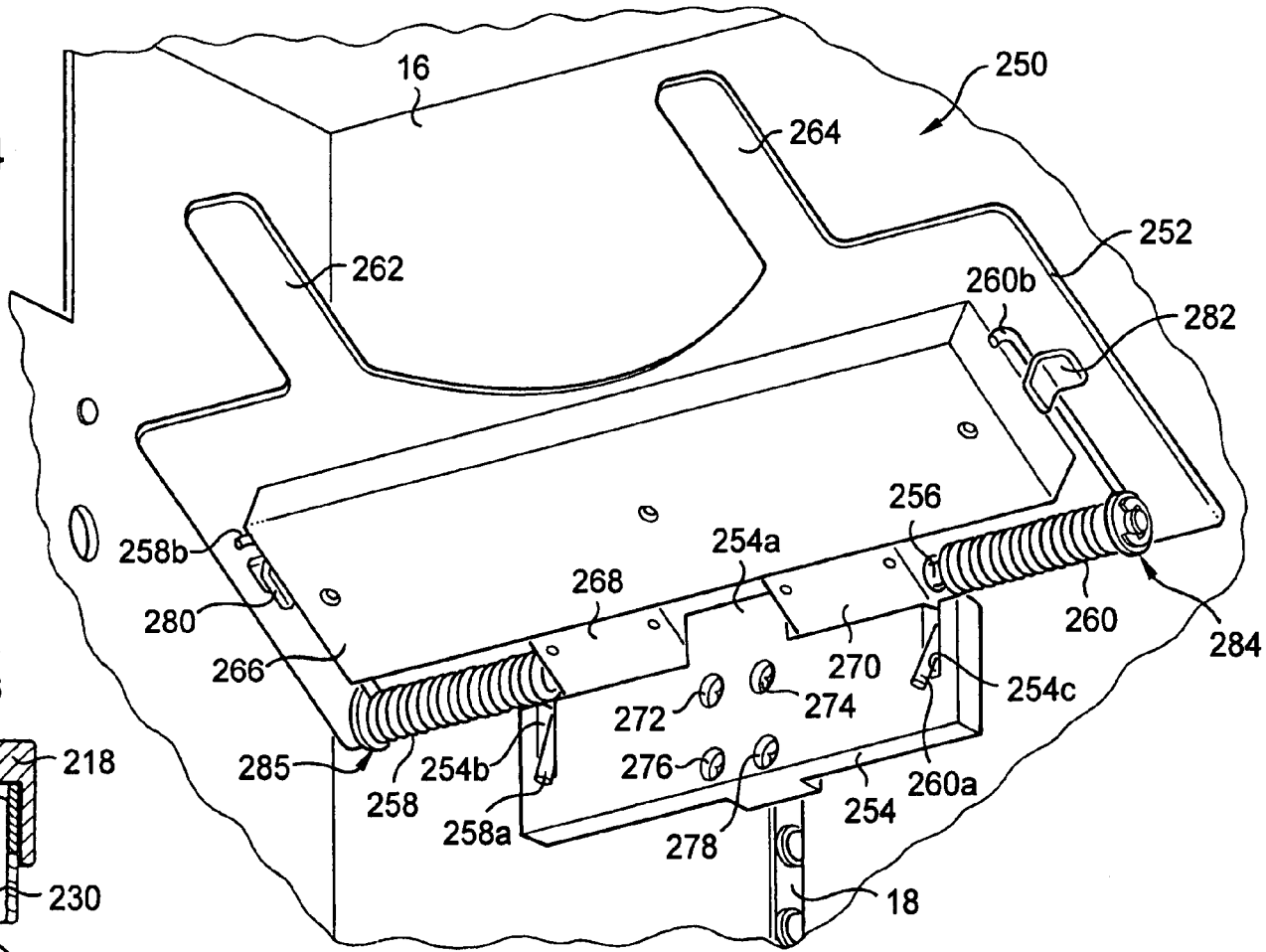
FIGS. 14 and 15 are two different perspective views of a document support 250 conforming to a first variant in another embodiment.
Figure 13:
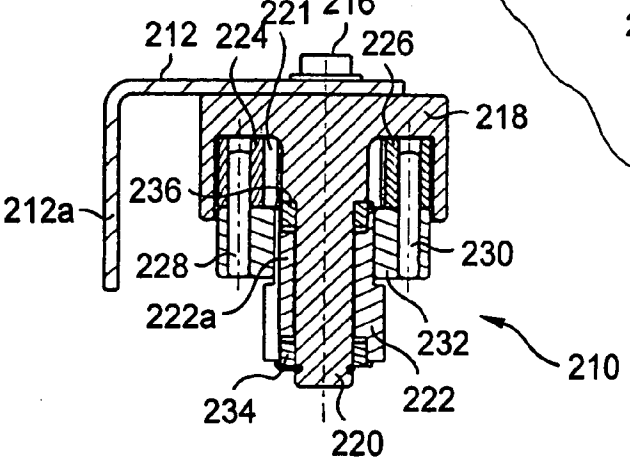
FIG. 13 is a view in cross section of a braking mechanism 210 shown in FIG. 12.
Figure 15:
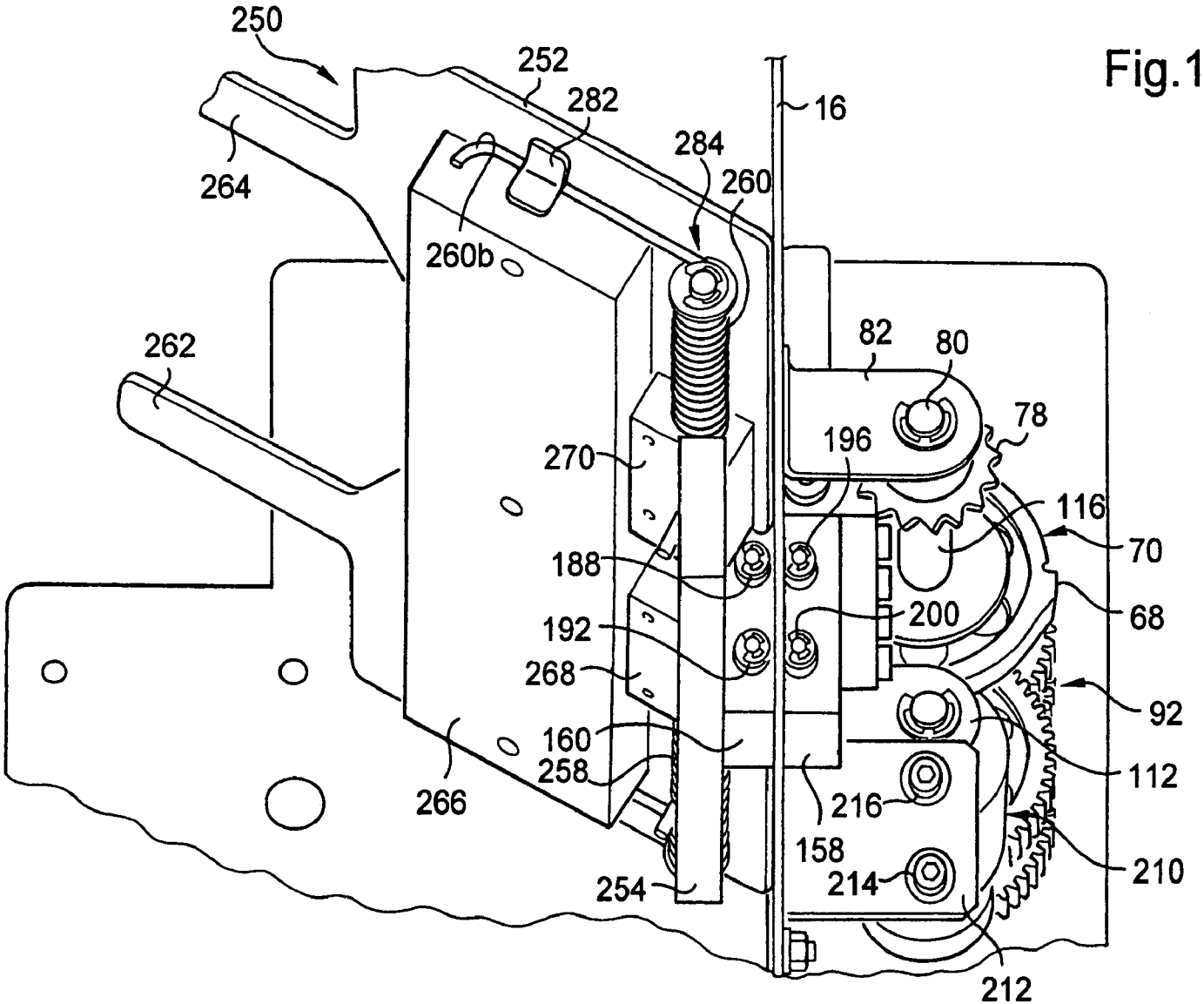

In an embodiment shown in FIGS. 14 and 15, the document support 250 has the feature of being orientable automatically relative to the horizontal. The support 250 comprises two parts, of which one part 252 forms a plate articulated relative to a base part 254, which has a fixed orientation, about a horizontal transverse shaft 256 on which two elastic members 258, 260 are mounted. When there are no documents on the support, these members hold the plate in a raised position. The elastic members take the form of torsion springs each bearing on the plate 252 and on the base 254, and they therefore tend to open up the angle between the plate and the fixed base, i.e. to raise the plate.

Accordingly, when documents are present on the support, the spring members 258 and 260 are elastically urged and orient the plate 252 in a position that is lower relative to the initial, raised position when there are no documents on the support. Clearly the support adopts a particular lowered position for a number of documents corresponding to a given weight.

More particularly, the portion of the plate 252 that is farthest from the wall 16 comprises two tabs 262, 264 forming coplanar extensions of the plate. These tabs enable the support to accept large documents without significantly increasing the weight of the plate 252. This notched shape of the support also facilitates grasping documents to remove them from said support. A plate 266 is fixed under the plate 252 to make the weight of the empty support sufficient to overcome the residual forces exerted by the mechanism 92 and to allow said support to descend when the actuator member is operated. Two blocks 268, 270 are fixed to the bottom of the plate 252 and the rod forming the transverse axis 256 is inserted into a cylindrical housing passing through them. The assembly formed of the plate 266, the blocks 268, 270, and even the brackets 280, 282, could instead be in one piece. The base 254 of the support 250 is fixed to the counter slider 160 by fixing screws 270, 272, 274 and 276 inserted in the respective holes 176, 174, 180 and 178 shown in FIG. 11, which were not used for the support 150 shown in FIG. 10.

The substantially parallelepiped-shaped base 254 has in its middle portion centered on the slot 18 a rectangular extension 254*a* through which a cylindrical housing, in which the rod 256 is inserted, passes in the direction of the length of the parallelepiped. The rectangular extension 254*a* is inserted between the two blocks 268 and 270 fastened to the plate 252. The two torsion springs 258 and 260 are locked in position between the fixed and mobile portions of the support 250.

To be more precise, the torsion spring 258 (respectively 260) has two opposite ends 258*a* and 258*b* (respectively 260*a* and 260*b*) that respectively co-operate with an appropriate housing 254*b* (respectively 254*c*) of the base plate 254 and with a bracket 280 (respectively 282) fixed to the plate 252. The ends 258*b* and 260*b* of the springs are each arranged between one edge of the plate 266 and the flange of the corresponding bracket 280, 282, thereby limiting axial movement of the springs toward each other.

To prevent the removal of the springs, a washer 284 and a circlip 285 at each of the two ends of the rod 256, in conjunction with the brackets 280 and 282, retain said springs axially. Accordingly, thanks to the articulated mechanism described above, in addition to the support moving longitudinally, a portion thereof may be oriented at an angle to the horizontal.

The dimensions of the elastic members are such that they may support a maximum document load and allow the support to tilt automatically to a given angular orientation for that maximum load (plate in its lowermost position). For a lower load, the support automatically adopts a different orientation (when the plate is in an intermediate, raised position). It should be noted that other types of elastic members may be used to fulfill the function of the torsion elastic members just described, namely to establish a given angular position as a function of a given weight, i.e. a given number of documents.

Figure 16:
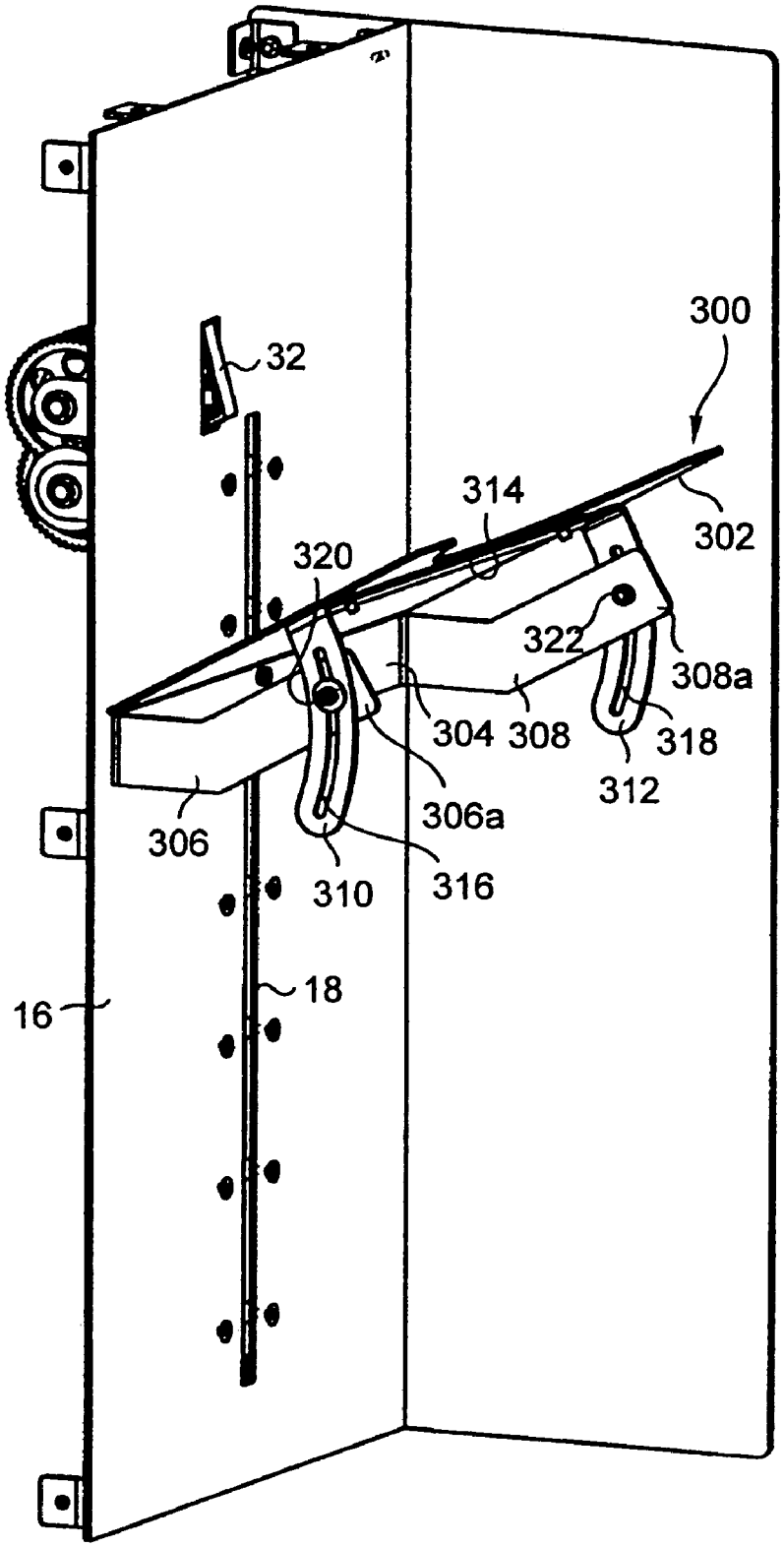
FIG. 16 shows a document support 300 conforming to a second variant in another embodiment.

Another embodiment of a device of the invention for receiving documents, shown in FIG. 16, has a support 300 comprising a portion 302 forming a plate that is intended to receive the documents and is articulated to a fixed orientation portion comprising a base 304 analogous to the base 254 shown in FIGS. 14 and 15. This base is fixed in exactly the same way to the counter-slider 160 of the carriage 152 shown in FIG. 10. The plate 302 has a shape analogous to that of the plate 252 shown in FIGS. 14 and 15. The support also comprises two arms 306 and 308 fastened to the base 304 and whose free ends 306*a* and 308*a* respectively co-operate with arcuate guides 310 and 312 fastened to a strip 314 fixed to the plate 302.

The arcuate guides 310 and 312 each comprise a respective arcuate slot 316, 318 in which respective fixing means 320, 322 (for example nuts and bolts) are provided. The support 300 may therefore be manually oriented in different angular positions, as the required inclination of the plate 302 to the horizontal is set by the positions of the fixing means 320 and 322 in the guide slots 316 and 318, this position being adjusted manually by the user of the device.

In an embodiment of the application, the support may be adapted to be oriented. Additionally, the support may be adapted to be oriented manually. Alternatively, the support may be adapted to be oriented automatically. Furthermore, the longitudinal movement of the support may be a vertical movement While preferred embodiments of the invention have been described and illustrated above, it should be understood that these are exemplary of the invention and are not to be considered as limiting. Additions, deletions, substitutions, and other modifications can be made without departing from the spirit or scope of the present invention. Accordingly, the invention is not to be considered as limited by the foregoing description but is only limited by the scope of the appended claims.

I claim:

1. An apparatus for receiving documents, comprising:

at least one document support member, adapted to receive documents and to be moved along a longitudinal axis by its own weight, and an actuator member for allowing said support to move, placed on the path of movement of the documents and adapted to move between a first or blocking position preventing longitudinal movement of said support and a second or released position allowing longitudinal displacement thereof, movement from the first position to the second position being triggered as soon as a document applies a force to said actuator member, further comprising:

a support resetting mechanism for returning said support to an initial position when it reaches the end of its longitudinal movement; and a brake that is adapted to slow the longitudinal movement of the support when the actuator member is in the released position, wherein the actuator member is adapted to pivot about an axis perpendicular to the longitudinal axis.

2. An apparatus according to claim 1, wherein the actuator member is adapted to return to its first position after allowing the support to move, thereby preventing further movement until a new document arrives.

3. An apparatus according to claim 1, wherein the actuator member when in the blocking position is adapted to co-operate with an abutment member that is connected to the support in such a manner that, when the actuator member is in the released position, movement of the abutment member is driven by longitudinal movement of the support under its own weight.

4. An apparatus according to claim 3, wherein the abutment member is part of a cam that is adapted to rotate when the actuator member is in the released position.

5. An apparatus according to claim 3, further comprising:

means for reducing the mechanical torque needed to release the actuator member.

6. An apparatus according to claim 5, wherein, the abutment member rotates about a main axis, the means for reducing the mechanical torque needed to release the actuator member are, from the kinematic point of view, between the main axis and the abutment member; and the brake is adapted to co-operate with one of the gears of a train of multiplier gears.

7. The apparatus according to claim 1, wherein the support is a plate and the support has a fixed orientation.

8. The apparatus according to claim 1, wherein the support is adapted to be oriented automatically and further comprising a plurality of elastic members for holding the support which are adapted, if there are no documents on the support, to hold the latter in a raised position and, if there are documents on the support, to be elastically urged in such a manner as to orient the support in at least one lowered position.

9. An apparatus for receiving documents, comprising:

at least one document support member, adapted to receive documents and to be moved along a longitudinal axis by its own weight, and an actuator member for allowing said support to move, placed on the path of movement of the documents and adapted to move between a first or blocking position preventing longitudinal movement of said support and a second or released position allowing longitudinal displacement thereof, movement from the first position to the second position being triggered as soon as a document applies a force to said actuator member, wherein the actuator member when in the blocking position is adapted to co-operate with an abutment member that is connected to the support in such a manner that, when the actuator member is in the released position, movement of the abutment member is driven by longitudinal movement of the support under its own weight, further comprising:

means for reducing the mechanical torque needed to release the actuator member, wherein, the means for reducing the torque needed to release the actuator member comprise a train of multiplier gears.

10. An apparatus for receiving documents, comprising:

at least one document support member, adapted to receive documents and to be moved along a longitudinal axis by its own weight, and an actuator member for allowing said support to move, placed on the path of movement of the documents and adapted to move between a first or blocking position preventing longitudinal movement of said support and a second or released position allowing longitudinal displacement thereof, movement from the first position to the second position being triggered as soon as a document applies a force to said actuator member, wherein the actuator member when in the blocking position is adapted to co-operate with an abutment member that is connected to the support in such a manner that, when the actuator member is in the released position, movement of the abutment member is driven by longitudinal movement of the support under its own weight, wherein, the support is on one side of a separating wall and is connected to a connecting mechanism that is on the other side of the wall and is fastened to the abutment member via a longitudinal slot in the wall, wherein the support is mounted on a carriage fastened to the connecting mechanism and wherein the carriage is fastened to a longitudinal movement transmission member that is part of the connecting mechanism and that runs around two transverse axes longitudinally spaced by a distance substantially equal to the travel of the support, and is adapted to rotate about these axes.

11. An apparatus according to claim 10, wherein the actuator member comprises a first portion and a second portion and, when the actuator member is in the blocking position, the first portion projects from the support side of the wall and the second portion projects from the other side of the wall and co-operates with the abutment member.

12. An apparatus according to claim 10, wherein the carriage co-operates with a slideway.

13. An apparatus according to claim 10, wherein the carriage co-operates with a guide wall.

14. An apparatus according to claim 10, wherein the abutment member is adapted to rotate about an axis whose rotation is kinematically coupled to one of the transverse axes.

15. An apparatus according to claim 14, further comprising:

a freewheel mounted on the main transverse axis; and wherein the abutment member rotates about a main axis and the brake is between the main axis and the abutment member.

16. An apparatus according to claim 10, wherein, the slideway is on the connecting mechanism side of the wall; and the guide wall is the separating wall, the carriage co-operating with the edges of the slot to guide its longitudinal movement.

* * * * *